US009945336B2

(12) United States Patent
Shen

(10) Patent No.: US 9,945,336 B2
(45) Date of Patent: Apr. 17, 2018

(54) FUEL SUPPLY DEVICE AND RETURN FUEL UTILIZATION BUFFER JAR

(71) Applicant: TOP 1 GREEN DEVELOPMENT CO., LTD., Taipei (TW)

(72) Inventor: Wan Kang Shen, Taipei (TW)

(73) Assignee: TOP 1 GREEN DEVELOPMENT CO., LTD., Taipei (TW)

( * ) Notice: Subject to any disclaimer, the term of this patent is extended or adjusted under 35 U.S.C. 154(b) by 179 days.

(21) Appl. No.: 15/155,080

(22) Filed: May 16, 2016

(65) Prior Publication Data

US 2017/0058848 A1 Mar. 2, 2017

(30) Foreign Application Priority Data

Aug. 28, 2015 (TW) ..... 104213956 U

(51) Int. Cl.

| | |
|---|---|
| ***F02M 37/00*** | (2006.01) |
| ***F02M 33/02*** | (2006.01) |
| ***F02M 33/00*** | (2006.01) |
| ***F02M 37/22*** | (2006.01) |

(52) U.S. Cl.

CPC ..... *F02M 37/0052* (2013.01); *F02M 33/00* (2013.01); *F02M 33/02* (2013.01); *F02M 37/0023* (2013.01); *F02M 37/22* (2013.01); *F02M 37/0017* (2013.01)

(58) Field of Classification Search

CPC .... F02M 37/0052; F02M 33/00; F02M 37/22; F02M 37/0023; F02M 33/02; F02M 37/0017; F02M 25/0854; F02D 41/004; F02D 41/0032

See application file for complete search history.

(56) References Cited

U.S. PATENT DOCUMENTS

| | | | | |
|---|---|---|---|---|
| 4,658,796 A * | 4/1987 | Yoshida | F02M 25/0854 | 123/516 |
| 6,189,516 B1 * | 2/2001 | Hei Ma | F02M 17/26 | 123/514 |
| 6,739,350 B1 * | 5/2004 | Op De Beeck | B60K 15/03504 | 123/519 |
| 2007/0199547 A1 * | 8/2007 | Shears | F02M 37/0047 | 123/518 |
| 2009/0020104 A1 * | 1/2009 | Karasawa | F02M 37/20 | 123/530 |

* cited by examiner

*Primary Examiner* — Sizo Vilakazi

(74) *Attorney, Agent, or Firm* — Leong C. Lei

(57) ABSTRACT

A fuel supply device includes a return fuel utilization buffer jar that conducts fuel into a fuel inlet port of a first three-way valve including a one-way check valve to allow the fuel to flow, uni-directionally, from the fuel inlet port to a fuel outlet port. Return fuel from an engine is conducted in through a return fuel inlet port of the return fuel utilization buffer jar. Fuel vapor in the return fuel utilization buffer jar is guided from a gas inlet port of a second three-way valve through a gas outlet port to a fuel tank. Vapor pressure in the return fuel utilization buffer jar is regulated by a ventilation port that is mounted in the second three-way valve and includes a one-way check valve in a direction toward the gas inlet port.

12 Claims, 5 Drawing Sheets

1314

1314

FUEL SUPPLY DEVICE AND RETURN FUEL UTILIZATION BUFFER JAR

TECHNICAL FIELD OF THE INVENTION

The present invention relates generally to an automobile accessory, and more particularly to a fuel supply device and a return fuel utilization buffer jar.

DESCRIPTION OF THE PRIOR ART

During the progress of science and technology for human living, automobiles are undoubtedly a measure that suits the need of transportation for human beings and additionally provide comfortableness of riding for the transportation of human beings. In the early days, the development of the automobiles does not focus on air pollution caused by the automobiles, and there was also no concern about the efficiency of operation of the automobiles for the need of green energy and environmental protection.

Recently, with the emergence of consciousness of environmental protection, new trends have been brought out for making the development of automobiles in conformity with the desires of green energy and environmental protection in respect of the issues of reduction of air pollution caused by automobiles and reduced energy consumption through improving operation efficiency of the automobiles. Due to the gradual exhaustion of fossil energy, people have now paid more attention to reducing fuel consumption and improving operation efficiency of automobiles. In light of this, all the automobile manufacturers have been devoted themselves to new techniques and solutions, seeking for reduction of fuel consumption and improvement of operation efficiency of automobiles.

SUMMARY OF THE INVENTION

In view of the above, an object of the present invention is to provide a fuel supply device and a return fuel utilization buffer jar, which enable effective use of high temperature fuel returning from an engine to achieve the purposes of saving energy and increasing engine operation efficiency.

To achieve the above object, the present invention provides a fuel supply device, which is applicable to supplying fuel necessary for an operation of a rotary high-pressure fuel distribution engine. The fuel supply device comprises a first three-way valve, a second three-way valve, and a return fuel utilization buffer jar.

The first three-way valve comprises a fuel inlet port, a fuel outlet port, and a return fuel receiving port. A reversal flow prevention device is arranged between the fuel inlet port and the fuel outlet port so as to constrain fuel to flow, in one direction, from the fuel inlet port to the fuel outlet port. The fuel outlet port and the return fuel receiving port are connected to and in communication with each other. The second three-way valve comprises a gas inlet port, a gas outlet port, and a ventilation port. A one-way reversal flow prevention device is arranged between the ventilation port and the gas inlet port for constraining flow in one direction from the ventilation port to the gas inlet port. The gas inlet port and the gas outlet port are connected to and in communication with each other.

The return fuel utilization buffer jar comprises a hollow jar portion and a buoy arranged in interior of the hollow jar portion. The hollow jar portion has a lower portion in which a return fuel inlet port and a return fuel outlet port in communication with the interior are formed. The hollow jar portion has an upper portion in which a fuel vapor recovery hole in communication with the interior is formed. The return fuel inlet port functions to conduct in return fuel from the rotary high-pressure fuel distribution engine and vapor of the return fuel vapor is conducted out, from the fuel vapor recovery hole, via the gas inlet port of the second three-way valve. When a liquid level of the return fuel in the hollow jar portion is higher than a threshold level, the buoy is moved by buoyance to open a passage so as to allow the return fuel in the hollow jar portion to flow from the return fuel outlet port, through the return fuel receiving port of the first three-way valve, to the rotary high-pressure fuel distribution engine.

The return fuel utilization buffer jar comprises a connection rod. The connection rod has an end that is in a conical form. The hollow jar portion comprises a jar body, an upper cap, a lower cap, and a guide post. The upper cap is coupled to and closes the jar body and comprises an upper shaft hole and the fuel vapor recovery hole formed therein. The lower cap is mounted to the lower end of the jar body and comprises the return fuel inlet port and a post hole formed therein. The guide post is retained in a post hole and comprises a central hole and the return fuel outlet port formed therein. The central hole has a lower end that is located in the return fuel outlet port and is in a conical form such that when the connection rod is set up in the upper shaft hole and the central hole, upward/downward movement the buoy selectively opens/closes the passage that is established between the return fuel outlet port and the lower end of the central hole.

In one embodiment, each of the upper cap and the lower cap comprises an O-ring for sealing against the hollow jar portion and preventing leakage of fuel.

In one embodiment, the upper cap and the lower cap comprise a transparent fuel tube connected therebetween for observation of the liquid level in the hollow jar portion.

In one embodiment, the lower cap is provided with a temperature sensor coupling seat mounted thereto for coupling with a temperature sensor, such that the temperature sensor so coupled may detect a fuel temperature of return fuel in the return fuel utilization buffer jar.

In one embodiment, the first three-way valve of the fuel supply device comprises a holed seat and a valve seat. The holed seat comprises a holed seat junction surface, a holed seat external surface, and a holed seat lateral surface. The fuel outlet port is formed and arranged on the holed seat lateral surface. The return fuel receiving port is formed and arranged on the holed seat external surface. The holed seat junction surface comprises a passage trough formed therein and connected between and in communication with the return fuel receiving port and the fuel outlet por. The valve seat comprises a valve seat junction surface, a valve seat external surface, and a valve seat lateral surface. The fuel inlet port is formed and arranged on the valve seat external surface. The valve seat junction surface comprises a circling groove formed therein and corresponding to a circumference of the passage trough, a threaded hole formed inboard the circling groove, and a valve hole in communication with the fuel inlet port. The circling groove receives an O-ring disposed therein. The threaded hole receives a membrane spring, which selectively covers and closes the valve hole, and a retention board, which limits an opening angle of the membrane spring, to be sequentially fixed thereto.

In one embodiment, the second three-way valve of the fuel supply device comprises a holed seat and a valve seat. The holed seat comprises a holed seat junction surface, a holed seat external surface, and a holed seat lateral surface.

The gas inlet port is formed and arranged on the holed seat lateral surface. The gas outlet port is formed and arranged on the holed seat external surface. The holed seat junction surface comprises a passage trough formed therein and connected between and in communication with the gas inlet port and the gas outlet port. The valve seat comprises a valve seat junction surface, a valve seat external surface, and a valve seat lateral surface. The ventilation port is formed and arranged on the valve seat external surface. The valve seat junction surface comprises a circling groove formed therein and corresponding to a circumference of the passage trough, a threaded hole formed inboard the circling groove, and a valve hole in communication with the ventilation port. The circling groove comprises an O-ring disposed therein. The threaded hole receives a membrane spring, which selectively covers and closes the valve hole, and a retention board, which limits an opening angle of the membrane spring, to be sequentially fixed thereto.

In summary, the present invention provides a fuel supply device and a return fuel utilization buffer jar thereof, which allows high temperature fuel collected and recovered from an engine to be directly re-supplied to the engine for recycling and reuse so as to prevent waste resulting from vaporization during the process of recovery of the high temperature fuel thereby achieving the purposes of saving energy and improving engine operation efficiency.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
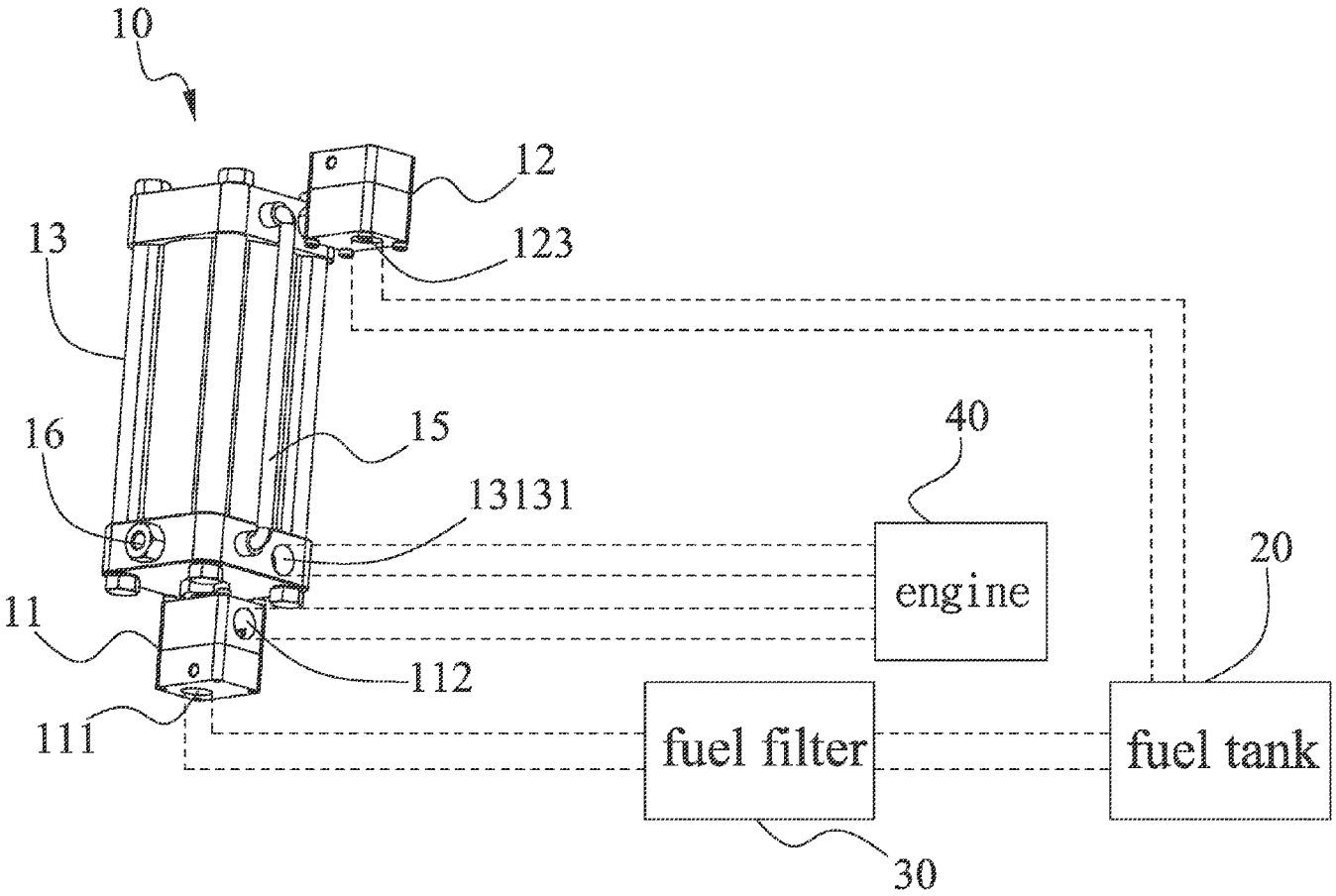
FIG. 1 is a schematic view illustrating a fuel supply device according to a preferred embodiment of the present invention and also illustrating an example of an application thereof.
Figure 2:
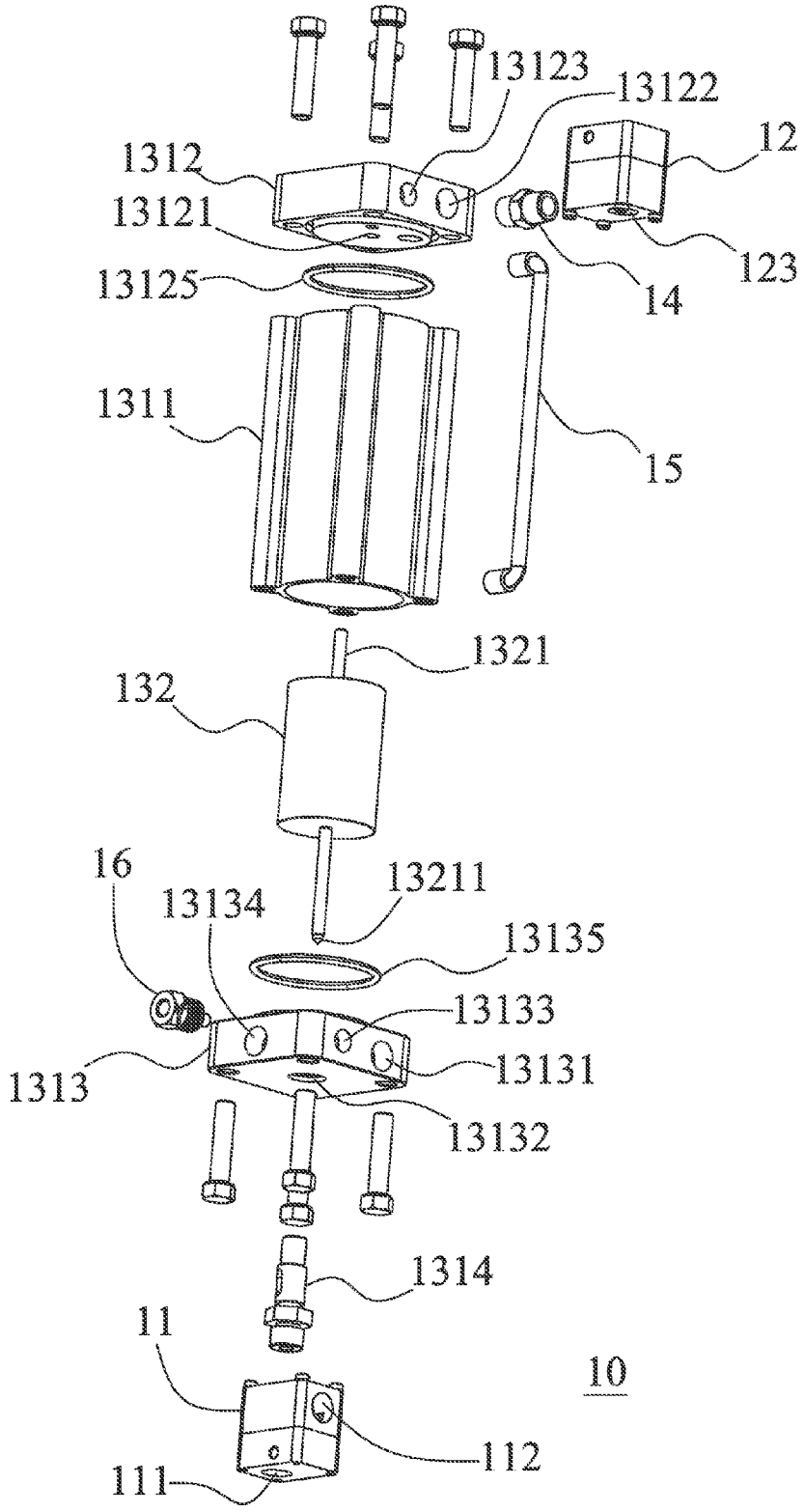
FIG. 2 is an exploded view illustrating a portion of the fuel supply device of FIG. 1.
Figure 3:
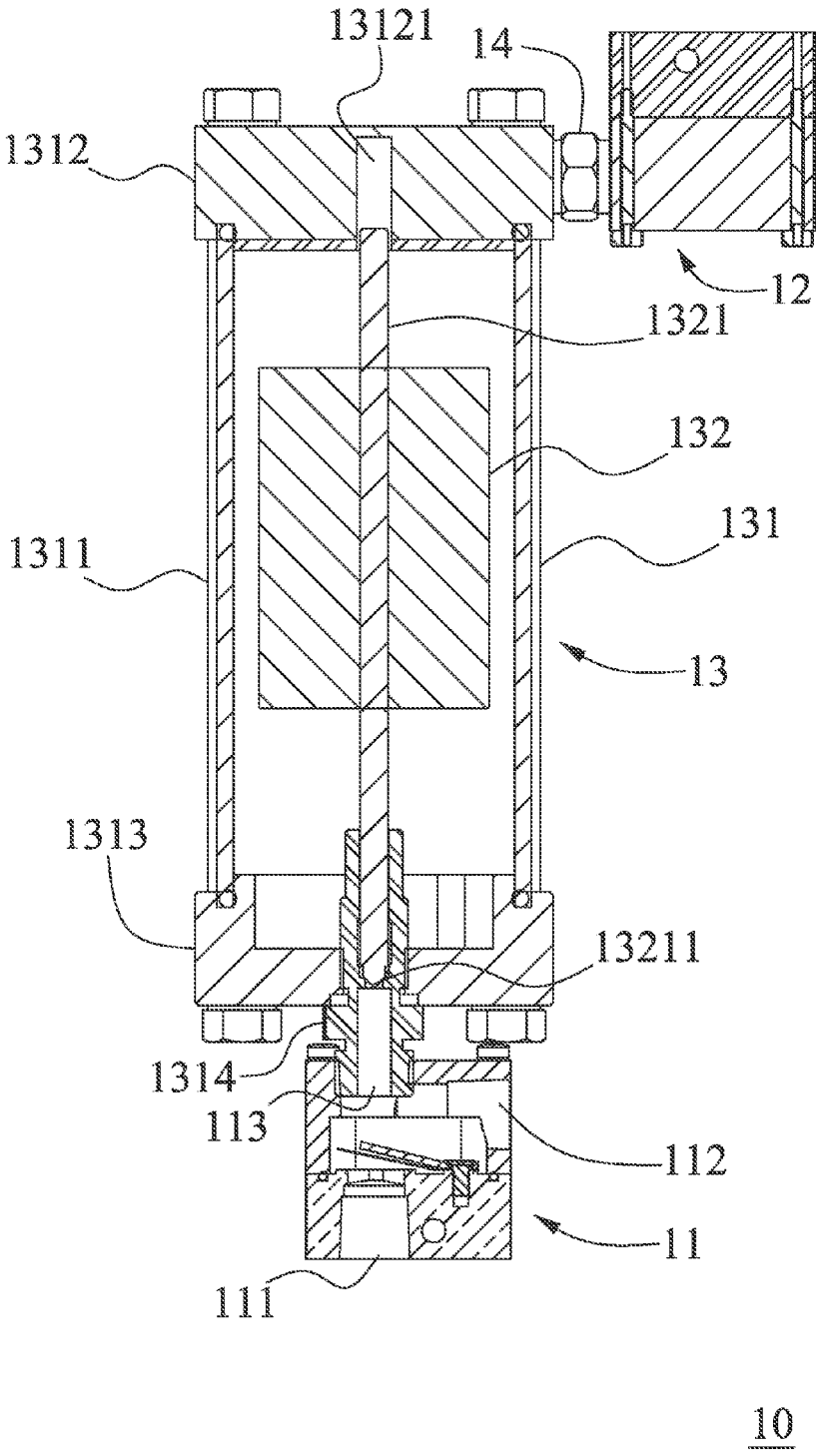
FIG. 3 is a cross-sectional view of the fuel supply device of FIG. 1.
Figure 5:
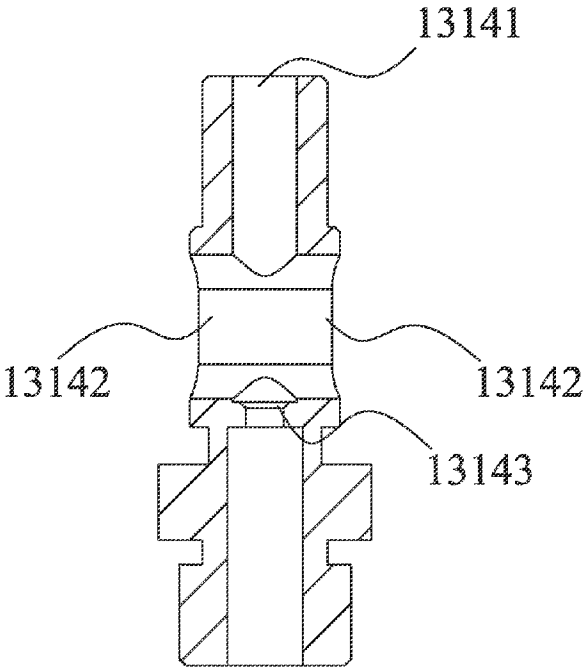
FIG. 5 is a cross-sectional view of the guide post of FIG. 4.
Figure 4:
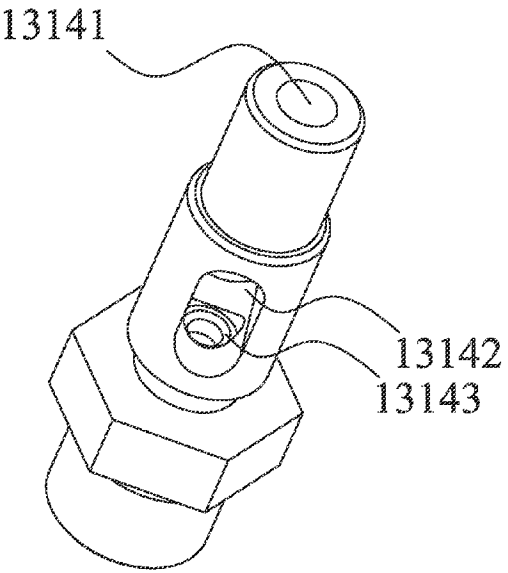
FIG. 4 is a perspective view illustrating a guide post of the fuel supply device of FIG. 1.
Figure 7:
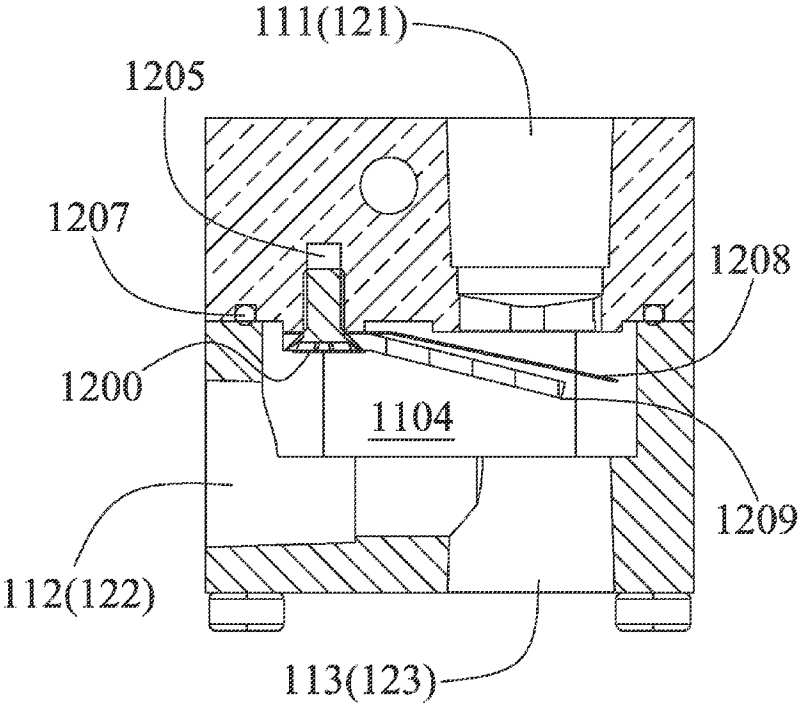
FIG. 7 is a cross-sectional view of the three-way valve of the fuel supply device of FIG. 1.
Figure 6:
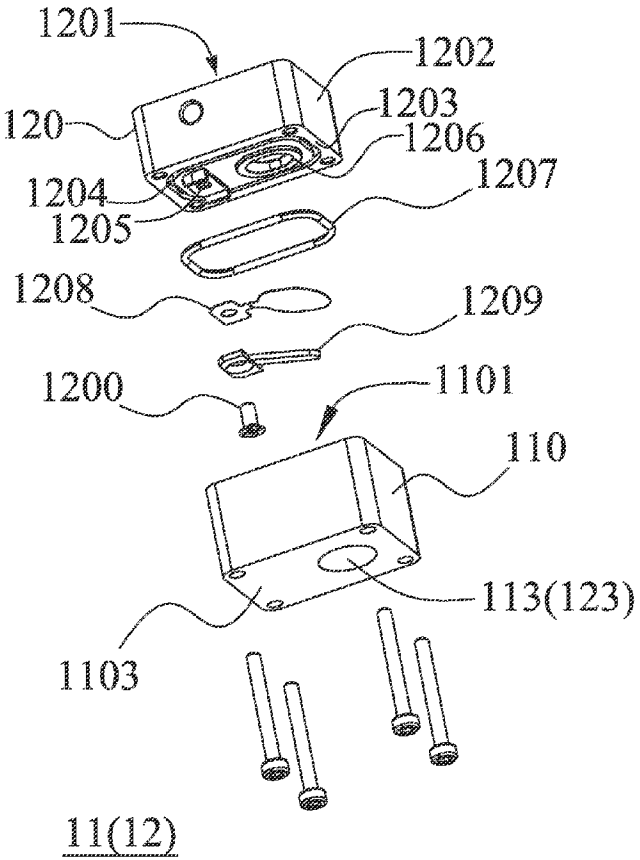
FIG. 6 is an exploded view illustrating a three-way valve of the fuel supply device of FIG. 1.

Referring to FIG. 1, a schematic view is provided for illustrating a fuel supply device according to a preferred embodiment of the present invention and also illustrating an example of an application thereof. As shown in the drawing, the fuel supply device 10 comprises three-way valves 11, 12 and a return fuel utilization buffer jar 13, which is applicable to supplying fuel necessary for an operation of a rotary high-pressure fuel distribution engine 40.

Generally speaking, fuel contained in a fuel tank 20 is first filtered by a fuel filter 30 and is then supplied to an injection pump of the rotary high-pressure fuel distribution engine 40 to be pressurized by the injection pump for distributing and feeding to injection nozzles of the rotary high-pressure fuel distribution engine 40 for atomization and combustion to generate power. During a process of compression and pressurization of fuel by the injection pump of the rotary high-pressure fuel distribution engine 40, excessive fuel is returned to the fuel tank 20 as return fuel. The return fuel, which has been pressurized, generally has a fuel temperature that is higher than a fuel temperature of the fuel supplied from the fuel tank 20. The fuel temperature of the return fuel is often between 72 to 75 degrees Celsius and may exhibit a phenomenon of being vaporized, making it inadequate to be directly fed into and used by the rotary high-pressure fuel distribution engine 40. Thus, the present invention provides the fuel supply device 10 that is arranged between the fuel tank 20 and the rotary high-pressure fuel distribution engine 40 in order to effectively collect and recover the return fuel for re-use for achieving the purposes of saving energy and improving engine operation efficiency.

Referring additionally to FIGS. 2, 3, 6, and 7, the three-way valve 11 comprises a holed seat 110 and a valve seat 120. The holed seat 110 comprises a holed seat junction surface 1101, a holed seat lateral surface 1102, and a holed seat external surface 1103. A fuel outlet port 112 is formed and arranged on the holed seat lateral surface 1102. A return fuel receiving port 113 is formed and arranged on the holed seat external surface 1103. The holed seat junction surface 1101 comprises a passage trough 1104 formed therein and connected between and communicating with the return fuel receiving port 113 and the fuel outlet port 112. The valve seat 120 comprises a valve seat external surface 1201, a valve seat lateral surface 1202, and a valve seat junction surface 1203. A fuel inlet port 111 is formed and arranged on the valve seat external surface 1201. The valve seat junction surface 1203 comprises a circling groove 1204 formed therein to correspond to an outer circumference of the passage trough 1104, a threaded hole 1205 that is formed inboard the circling groove 1204, and a valve hole 1206 in communication with the fuel inlet port 111. The circling groove 1204 receives an O-ring 1207 disposed therein. Fixed, in sequence, to the threaded hole 1205 by a screw 1200 are a retention board 1209 that limits an opening angle of a membrane spring 1208 and the membrane spring 1208 that selectively covers and closes the valve hole 1206.

Thus, the three-way valve 11 comprises the fuel inlet port 111, the fuel outlet port 112, and the return fuel receiving port 113. Between the fuel inlet port 111 and the fuel outlet port 112, the membrane spring 1208 that selectively covers and closes the valve hole 1206 provides a function of a check valve to limit fuel to be fed uni-directionally from the fuel inlet port 111 to the fuel outlet port 112. The fuel outlet port 112 and the return fuel receiving port 113 are connected and in communication with each other by through the passage trough 1104. The membrane spring 1208 is a temperature-resistant metal film and is preferably capable of resisting negative suction pressure of 0.05-0.1 Pa and also resisting positive suction pressure of 2-5 Pa so as to exhibit properties of low resistance, reversal prevention, and large flow rate.

The three-way valve 12 comprises a holed seat 110 and a valve seat 120. The holed seat 110 comprises a holed seat junction surface 1101, a holed seat lateral surface 1102, and a holed seat external surface 1103. An gas inlet port 122 is formed and arranged on the holed seat lateral surface 1102. An gas outlet port 123 is formed and arranged on the holed seat external surface 1103. The holed seat junction surface 1101 comprises a passage trough 1104 formed therein and connected between and communicating with the gas inlet port 122 and the gas outlet port 123. The valve seat 120 comprises a valve seat junction surface 1203, a valve seat external surface 1201, and a valve seat lateral surface 1202. A ventilation port 121 is formed and arranged on the valve seat external surface 1201. The valve seat junction surface 1203 comprises a circling groove 1204 formed therein to correspond to an outer circumference of the passage trough 1104, a threaded hole 1205 that is formed in board the circling groove 1204, and a valve hole 1206 in communication with the ventilation port 121. The circling groove 1204 receives an O-ring 1207 disposed therein. Fixed, in sequence, to the threaded hole 1205 by a screw 1210 are a retention board 1209 that limits an opening angle of a membrane spring 1208 and the membrane spring 1208 that selectively covers and closes the valve hole 1206.

Thus, the three-way valve 12 comprises the gas inlet port 122, the gas outlet port 123, and the ventilation port 121. Between the ventilation port 121 and the gas inlet port 122, the membrane spring 1208 that selectively covers and closes the valve hole 1206 provides a function of a one-way check valve constraining flow in one direction from the ventilation port 121 to the gas inlet port 12 in order to regulate fuel vapor pressure in the return fuel utilization buffer jar 13. The gas inlet port 122 and the gas outlet port 123 are connected to and in communication with each other through the passage trough 1104.

Referring collectively to FIGS. 2-5, the return fuel utilization buffer jar 13 comprises a hollow jar portion 131 and a buoy 132 arranged in the hollow jar portion 131. The buoy 132 comprises a connection rod 1321. The connection rod 1321 has an end 13211 that is in a conical form. The hollow jar portion 131 comprises a jar body 1311, an upper cap 1312, a lower cap 1313, and a guide post 1314. The upper cap 1312 is hermetically coupled, through an O-ring 13125, to the jar body 1311 and comprises an upper shaft hole 13121, a fuel vapor recovery hole 13122, and an upper liquid level hole 13123 formed therein. The fuel vapor recovery hole 13122 and the upper liquid level hole 13123 are arranged to provide communication between inside and outside of the hollow jar portion 131 in order to conduct the vapor of return fuel contained inside the hollow jar portion 131 from the fuel vapor recovery hole 13122, through a double-end-threaded adaptor 14, to the gas inlet port 122 of the three-way valve 12.

The lower cap 1313 is hermetically coupled, through an O-ring 13135, to a bottom of the jar body 1311 and comprises a return fuel inlet port 13131, a post hole 13132, a lower liquid level hole 13133, and a seat hole 13134 formed therein for communication between the inside and outside of the hollow jar portion 131 in order to conduct return fuel from the rotary high-pressure fuel distribution engine 40 into the hollow jar portion 131. A transparent fuel tube 15 is connected between the upper liquid level hole 13123 and the lower liquid level hole 13133 for observation and recognition of liquid level inside the hollow jar portion 131.

Further, the seat hole 13134 is provided with a temperature sensor coupling seat 16 mounted thereto for coupling with a temperature sensor for temperature detection when detection of the fuel temperature of the return fuel inside the return fuel utilization buffer jar 13 is desired. The guide post 1314 is fixed, in a hermetical manner, to and received in the post hole 13132 of the lower cap 1313 and comprises a central hole 13141 and a return fuel outlet port 13142 formed therein. The central hole 13141 has a lower end 13143 that is located in the return fuel outlet port 13142 and is in a conical form for mating the conical end 13211 of the connection rod 1321 of the buoy 132 when the connection rod 1321 is set up in the upper shaft hole 13121 and the central hole 13141, so that a passage may be selectively established or blocked between the return fuel outlet port 13142 and the lower end 13143 of the central hole 13141 by means of upward/downward movement of the buoy 132.

In other words, when the liquid level of the return fuel received in the hollow jar portion 13 is higher than a threshold level, the buoy 132 is moved by buoyance to open the passage. In this condition, the return fuel inside the hollow jar portion 13 is allowed to flow through the return fuel outlet port 13142 of the guide post 1314 to the conical lower end 13143 of the central hole 13141 to further flow from the return fuel receiving port 113 of the three-way valve 11, via the fuel outlet port 112, into the rotary high-pressure fuel distribution engine 40 for recovery and re-use.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A fuel supply device, which is applicable to supplying fuel necessary for an operation of a rotary high-pressure fuel distribution engine, comprising:

a first three-way valve, which comprises a fuel inlet port, a fuel outlet port, and a return fuel receiving port, a reversal flow prevention device being arranged between the fuel inlet port and the fuel outlet port so as to constrain fuel to flow, in one direction, from the fuel inlet port to the fuel outlet port, the fuel outlet port and the return fuel receiving port being connected to and in communication with each other;

a second three-way valve, which comprises a gas inlet port, a gas outlet port, and a ventilation port, a one-way reversal flow prevention device being arranged between the ventilation port and the gas inlet port for constraining flow in one direction from the ventilation port to the gas inlet port, the gas inlet port and the gas outlet port being connected to and in communication with each other; and a return fuel utilization buffer jar, which comprises a hollow jar portion and a buoy arranged in interior of the hollow jar portion, the hollow jar portion having a lower portion in which a return fuel inlet port and a return fuel outlet port in communication with the interior are formed, the hollow jar portion having an upper portion in which a fuel vapor recovery hole in communication with the interior is formed, wherein the return fuel inlet port functions to conduct in return fuel from the rotary high-pressure fuel distribution engine and vapor of the return fuel vapor is conducted out, from the fuel vapor recovery hole, via the gas inlet port of the second three-way valve and wherein when a liquid level of the return fuel in the hollow jar portion is higher than a threshold level, the buoy is moved by buoyance to open a passage so as to allow the return fuel in the hollow jar portion to flow from the return fuel outlet port, through the return fuel receiving port of the first three-way valve, to the rotary high-pressure fuel distribution engine.

2. The fuel supply device according to claim 1, wherein the buoy comprises a connection rod, the connection rod having an end that is in a conical form, the hollow jar portion comprising:

a jar body;

an upper cap, which is coupled to and closes the jar body and comprises an upper shaft hole and the fuel vapor recovery hole formed therein;

a lower cap, which is mounted to the lower end of the jar body and comprises the return fuel inlet port and a post hole formed therein; and a guide post, which is retained in a post hole and comprises a central hole and the return fuel outlet port formed therein, the central hole having a lower end that is located in the return fuel outlet port and is in a conical form such that when the connection rod is set up in the upper shaft hole and the central hole, upward/downward movement the buoy selectively opens/closes the passage that is established between the return fuel outlet port and the lower end of the central hole.

3. The fuel supply device according to claim 2, wherein each of the upper cap and the lower cap comprises an O-ring for sealing against the hollow jar portion.

4. The fuel supply device according to claim 2, wherein the upper cap and the lower cap comprise a transparent fuel tube connected therebetween for observation of the liquid level in the hollow jar portion.

5. The fuel supply device according to claim 2, wherein the lower cap is provided with a temperature sensor coupling seat mounted thereto for coupling with a temperature sensor.

6. The fuel supply device according to claim 1, wherein the first three-way valve comprises:

a holed seat, which comprises a holed seat junction surface, a holed seat external surface, and a holed seat lateral surface, the fuel outlet port being formed and arranged on the holed seat lateral surface, the return fuel receiving port being formed and arranged on the holed seat external surface, the holed seat junction surface comprising a passage trough formed therein and connected between and in communication with the return fuel receiving port and the fuel outlet port; and a valve seat, which comprises a valve seat junction surface, a valve seat external surface, and a valve seat lateral surface, the fuel inlet port being formed and arranged on the valve seat external surface, the valve seat junction surface comprising a circling groove formed therein and corresponding to a circumference of the passage trough, a threaded hole formed inboard the circling groove, and a valve hole in communication with the fuel inlet port, the circling groove receiving an O-ring disposed therein, the threaded hole receiving a membrane spring, which selectively covers and closes the valve hole, and a retention board, which limits an opening angle of the membrane spring, to be sequentially fixed thereto.

7. The fuel supply device according to claim 1, wherein the second three-way valve comprises:

a holed seat, which comprises a holed seat junction surface, a holed seat external surface, and a holed seat lateral surface, the gas inlet port being formed and arranged on the holed seat lateral surface, the gas outlet port being formed and arranged on the holed seat external surface, the holed seat junction surface comprising a passage trough formed therein and connected between and in communication with the gas inlet port and the gas outlet port; and a valve seat, which comprises a valve seat junction surface, a valve seat external surface, and a valve seat lateral surface, the ventilation port being formed and arranged on the valve seat external surface, the valve seat junction surface comprising a circling groove formed therein and corresponding to a circumference of the passage trough, a threaded hole formed inboard the circling groove, and a valve hole in communication with the ventilation port, the circling groove comprising an O-ring disposed therein, the threaded hole receiving a membrane spring, which selectively covers and closes the valve hole, and a retention board, which limits an opening angle of the membrane spring, to be sequentially fixed thereto.

8. A return fuel utilization buffer jar, which is applicable to supplying fuel necessary for an operation of a rotary high-pressure fuel distribution engine, comprising:

a hollow jar portion, wherein the hollow jar portion has a lower portion comprising a return fuel inlet port and a return fuel outlet port formed therein and in communication with an interior thereof, the hollow jar portion having an upper portion comprising a fuel vapor recovery hole formed therein and in communication with the interior, wherein the return fuel inlet port functions to conduct in return fuel from the rotary high-pressure fuel distribution engine, vapor of the return fuel vapor being conducted out through the fuel vapor recovery hole; and a buoy, which is arranged in the interior of the hollow jar portion, wherein when a liquid level of the return fuel in the hollow jar portion is higher than a threshold level, the buoy is moved by buoyance to open a passage so as to allow the return fuel in the hollow jar portion to flow from the return fuel outlet port to the rotary high-pressure fuel distribution engine.

9. The return fuel utilization buffer jar according to claim 8, wherein the buoy comprises a connection rod, the connection rod having an end that is in a conical form, the hollow jar portion comprising:

a jar body;

an upper cap, which is coupled to and closes the jar body and comprises an upper shaft hole and the fuel vapor recovery hole formed therein;

a lower cap, which is mounted to the lower end of the jar body and comprises the return fuel inlet port and a post hole formed therein; and a guide post, which is retained in a post hole and comprises a central hole and the return fuel outlet port formed therein, the central hole having a lower end that is located in the return fuel outlet port and is in a conical form such that when the connection rod is set up in the upper shaft hole and the central hole, upward/downward movement the buoy selectively opens/closes the passage that is established between the return fuel outlet port and the lower end of the central hole.

10. The return fuel utilization buffer jar according to claim 9, wherein each of the upper cap and the lower cap comprises an O-ring for sealing against the hollow jar portion.

11. The return fuel utilization buffer jar according to claim 9, wherein the upper cap and the lower cap comprise a transparent fuel tube connected therebetween for observation of the liquid level in the hollow jar portion.

12. The return fuel utilization buffer jar according to claim 9, wherein the lower cap is provided with a temperature sensor coupling seat mounted thereto for coupling with a temperature sensor.

* * * * *